US009989313B2

(12) United States Patent
Hong et al.

(10) Patent No.: US 9,989,313 B2
(45) Date of Patent: Jun. 5, 2018

(54) SMELTING LADLE AND METHOD FOR IMPROVING USE EFFICIENCY THEREOF

(71) Applicant: WUGANG REFRACTORY CO., LTD., Wuhan (CN)

(72) Inventors: Xueqin Hong, Wuhan (CN); Xianming Tian, Wuhan (CN); Hui Zhou, Wuhan (CN); Zhiqiang Wang, Wuhan (CN); Qinxue Ma, Wuhan (CN); Zhongxing Lei, Wuhan (CN); Zhiming Cao, Wuhan (CN); Huasheng Liu, Wuhan (CN); Qing Zhao, Wuhan (CN); Bihui Yi, Wuhan (CN); Yuhan Diao, Wuhan (CN)

(73) Assignee: WUGANG REFRACTORY CO., LTD., Wuhan (CN)

( * ) Notice: Subject to any disclaimer, the term of this patent is extended or adjusted under 35 U.S.C. 154(b) by 25 days.

(21) Appl. No.: 15/083,316

(22) Filed: Mar. 29, 2016

(65) Prior Publication Data

US 2016/0209116 A1 Jul. 21, 2016

Related U.S. Application Data

(63) Continuation-in-part of application No. PCT/CN2014/087190, filed on Sep. 23, 2014.

(30) Foreign Application Priority Data

Sep. 29, 2013 (CN) ..... 2013 1 0454213
Sep. 15, 2014 (CN) ..... 2014 2 0530448 U
Sep. 16, 2014 (CN) ..... 2014 1 0472204

(51) Int. Cl.
*F27D 1/16* (2006.01)
*B22D 41/02* (2006.01)
(Continued)

(52) U.S. Cl.
CPC ..... *F27D 1/1621* (2013.01); *B22D 41/02* (2013.01); *F27D 1/0006* (2013.01);
(Continued)

(58) Field of Classification Search
CPC ..... B22D 41/02; F27D 2001/1605; F27D 2001/1621; F27D 2005/0075
(Continued)

(56) References Cited

U.S. PATENT DOCUMENTS

2016/0209116 A1* 7/2016 Hong ..... B22D 41/02

FOREIGN PATENT DOCUMENTS

JP 407228916 A * 8/1995

OTHER PUBLICATIONS

English Language translation of JP407228916 Aug. 29, 1995.*

* cited by examiner

*Primary Examiner* — Scott Kastler
(74) *Attorney, Agent, or Firm* — Matthias Scholl, PC; Matthias Scholl

(57) ABSTRACT

A smelting ladle and a method for improving use efficiency thereof. The smelting ladle includes a housing, a working layer, and a permanent layer. The method includes: 1) rebuilding the working layer to have an outer layer and an inner layer, the inner layer being a consumable working layer which contacts with molten steel and steel slag, and the outer layer being a circulating working layer which contacts with the permanent layer or directly contacts with the housing; 2) allowing the smelting ladle to work, when the thickness of the consumable working layer is reduced to be between 0 and 20 mm, removing a residue of the consumable working layer and masoning a new consumable working layer for the smelting ladle; and 3) repeating 2) until the circulating working layer reaches a designed service life
(Continued)

thereof, and casting a new circulating working layer for the smelting ladle.

13 Claims, 5 Drawing Sheets

(51) Int. Cl.
*F27D 1/00* (2006.01)
*F27D 5/00* (2006.01)

(52) U.S. Cl.
CPC ..... *F27D 1/0033* (2013.01); *F27D 1/16* (2013.01); *F27D 2005/0075* (2013.01)

(58) Field of Classification Search
USPC ..... 266/280
See application file for complete search history.

SMELTING LADLE AND METHOD FOR IMPROVING USE EFFICIENCY THEREOF

CROSS-REFERENCE TO RELATED APPLICATIONS

This application is a continuation-in-part of International Patent Application No. PCT/CN2014/087190 with an international filing date of Sep. 23, 2014, designating the United States, now pending, and further claims priority benefits to Chinese Patent Application No. 201310454213.7 filed Sep. 29, 2013, to Chinese Patent Application No. 201420530448.X filed Sep. 15, 2014, and to Chinese Patent Application No. 201410472204.5 filed Sep. 16, 2014. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

Field of the Invention

The invention relates to a smelting ladle and a method for improving use efficiency thereof.

Description of the Related Art

Typically, a ladle lining of a smelting ladle includes a permanent layer and a working layer. The working layer directly contacts the molten metal and the permanent layer maintains the high temperature. However, the existing working layers have poor resistance against high temperature scouring and erosion, and contribute to high consumption rate and high production costs of metals. In addition, the permanent layers either have poor thermal insulation properties or have poor erosion resistance.

SUMMARY OF THE INVENTION

In view of the above-described problems, it is one objective of the invention to provide a smelting ladle and a method for improving use efficiency thereof. The smelting ladle has good thermal insulation properties and thus reduces the production costs.

It is another objective of the invention to provide an improved smelting ladle that possesses excellent corrosion resistance, high safety performance, and excellent thermal insulation performance, thus prolonging the service life and reducing the material consumption thereof.

It is still another objective of the invention to provide another improved smelting ladle comprising a specific circulating working layer. The specific circulating working layer possesses the following features:

1) excellent working strength at high temperatures and good erosion resistance performance so that the safety factor of the smelting ladle is increased by at least between 3 and 5 times;

2) excellent integrity, thus effectively eliminating the possibility of the leakage of the molten steel from the brick joints of the permanent layer to the housing;

3) relatively low thermal conductivity and good thermal insulation performance; and 4) prolonged service lives of the working layer and the permanent layer, and greatly reduced refractory consumption of the smelting ladle.

To achieve the above objectives, in accordance with one embodiment of the invention, there is provided a method for improving use efficiency of a smelting ladle. The smelting ladle comprises a housing, a working layer, and a permanent layer. The method comprises:

1) rebuilding the working layer to have an outer layer and an inner layer, the inner layer being a consumable working layer which is formed by masoning and directly contacts with molten steel and steel slag, and the outer layer being a circulating working layer which is formed by casting and contacts with the permanent layer or directly contacts with the housing;

2) allowing the smelting ladle to work, when a thickness of the consumable working layer is reduced to be between 0 and 20 mm, which means a smelting stage of the smelting ladle is completed, removing a residue of the consumable working layer and masoning a new consumable working layer for the smelting ladle; and 3) repeating 2) until the circulating working layer reaches a designed service life thereof, and casting a new circulating working layer for the smelting ladle.

In a class of this embodiment, when the circulating working layer is partially eroded after one smelting stage of the smelting ladle, firstly, the circulating working layer is cleaned and repaired, and then the new consumable working layer is masoned. The designed service life of the circulating working layer is at least 10 times as long as the smelting stage of the smelting ladle.

In a class of this embodiment, there is provided a first smelting ladle applying the above method, the first smelting ladle comprises: the housing, the permanent layer, the circulating working layer, and the consumable working layer. The permanent layer is masoned or casted on an inner wall of the housing. The circulating working layer is casted on an inner wall of the permanent layer. The consumable working layer is masoned on an inner wall of the circulating working layer.

In a class of this embodiment, the permanent layer is masoned or casted by a refractory having a bulk density of $\geq 0.3$ g/cm$^3$, a compressive strength at a normal temperature of $\geq 2.0$ megapascal, and a refractory temperature of $\geq 1100°$ C. A thickness of the permanent layer is $\leq 150$ mm. Because the firm casting structure of the circulating working layer is designed, materials having sufficient low thermal conductivity can be employed by the permanent layer, which is only required to have good thermal insulation performance rather than possess capability of directly bearing erosion and souring of the molten steel and the slag. In a class of this embodiment, the thickness of the permanent layer is between 20 and 80 mm. Thus, the thermal insulation effect of the permanent layer and the use safety of the housing are ensured, and the material consumption of the permanent layer is saved.

In a class of this embodiment, the circulating working layer is casted by a refractory castable having a bulk density of $\geq 2.5$ g/cm$^3$ and a refractory temperature of $\geq 1600°$ C. A thickness of the circulating working layer is between 20 and 250 mm. Thus, the circulating working layer has excellent overall performance and no brick slit or shedding of the bricks, thereby ensuring the structural strength of the circulating working layer. In addition, the circulating working layer is resistant to the erosion and scouring of the molten steel or slag and has good thermal insulation effect.

In a class of this embodiment, the consumable working layer is masoned by refractory bricks having a bulk density of ≥2.8 g/cm$^3$ and a refractory temperature of ≥1600° C. A thickness of the consumable working layer is between 80 and 250 mm. Thus, the consumable working layer not only possesses excellent performance of resisting the souring of the molten steel and the erosion of the slag but also features convenience in cleaning and replacing the residual consumable working layer.

In accordance with still another embodiment of the invention, there is provided a second smelting ladle applying the above method. The second smelting ladle comprises: the housing, the circulating working layer, and the consumable working layer. The circulating working layer is casted on an inner wall of the housing, and the consumable working layer is casted on an inner wall of the circulating working layer.

In a class of this embodiment, the circulating working layer is casted by a refractory castable having a bulk density of ≥2.6 g/cm$^3$ and a refractory temperature of ≥1600° C. A thickness of the circulating working layer is between 100 and 250 mm. Because the permanent layer is deleted, the thickness of the circulating working layer is properly enlarged so as to ensure the structure strength as well and the thermal insulation effect of the circulating working layer.

In a class of this embodiment, the consumable working layer is masoned by refractory bricks having a bulk density of ≥2.8 g/cm$^3$ and a refractory temperature of ≥1600° C. The thickness of the consumable working layer is between 80 and 250 mm. Thus, the consumable working layer not only possesses excellent performance for resisting the souring of the molten steel and the erosion of the slag but also features convenience in cleaning and replacing the residual consumable working layer.

Advantages of the first and the second smelting ladles according to embodiments of the invention are as follows: the designed consumable working layer employs the masoned structure, which is substantially consumed at the end of each smelting stage of the smelting ladle, and reduces the waste of the refractory. The designed circulating working layer functions as the working layer as well as a safe layer, thus ensuring the safe and reliable operation of the permanent layer and the housing. The designed permanent layer can be further attenuated or even deleted on the premise of ensuring the thermal insulation performance of the smelting ladle and preventing the temperature of the smelting ladle from decreasing too fast. Thus, the smelting ladle of the invention is able to ensure the thermal insulation performance of each composed layer and greatly reduce the refractory consumption for smelting per ton of the molten steel. The discarded amount of the residual bricks for the consumable working layer of the smelting ladle is greatly reduced, materials for the composed layers are fully utilized, the service life of the smelting ladle is effectively prolonged, the operation cost for the smelting ladle is lowered, and the use efficiency of the smelting ladle is therefore improved.

In accordance with still another embodiment of the invention, there is provided a third smelting ladle applying the above method. The smelting ladle comprises: the housing, the permanent layer, the circulating working layer, the consumable working layer. The permanent layer comprises an inner permanent layer and an outer permanent layer. The permanent layer is masoned on an inner wall of the housing, the circulating working layer is casted on the inner wall of the permanent layer, and the consumable working layer is masoned on an inner wall of the circulating working layer. The permanent layer is formed by the inner permanent layer contacting with the circulating working layer and the outer permanent layer contacting with the housing. The inner permanent layer is masoned by a first heat insulating blocks. The outer permanent layer is masoned by alternate arrangement of the first heat insulating blocks and a second heat insulating blocks.

In a class of this embodiment, the first heat insulating blocks of the outer permanent layer are alternately disposed in a circumferential direction to form multiple circles from top downwards along the inner wall of the housing. Multiple of the second heat insulating blocks are disposed between adjacent first heat insulating blocks of a same circle. The first heat insulating blocks of adjacent two circles are staggered. Thus, the first heat insulating block and the second heat insulating block form a bridge-like structure, in which the first heat insulating block functions as a bridge pier supported between the inner permanent layer and the housing, and the second heat insulating block functions as a bridge deck for ensuring the thermal insulation performance of the permanent layer.

In a class of this embodiment, the first heat insulating blocks of the outer permanent layer are alternately disposed in the circumferential direction to form between 8 and 14 circles from top downwards along the inner wall of the housing. Between 3 and 5 second heat insulating blocks are disposed between the adjacent first heat insulating blocks of the same circle. Thus, the strength requirement as well as the thermal insulation performance of the permanent layer is realized.

In a class of this embodiment, the first heat insulating blocks of the outer permanent layer are arranged to form a network structure from the top downwards along the inner wall of the housing, and multiple of the second heat insulating block are filled in cavities of the network structure. The first heat insulating blocks and the second heat insulating blocks form structures similar to a Chinese character JIN, the first heat insulating blocks form supporting skeletons arranged between the inner permanent layer and the housing, and the multiple second heat insulating blocks form thermal insulation surfaces to ensure the thermal insulation performance of the permanent layer to the utmost.

In a class of this embodiment, the cavities of the network structure are in a shape of a rectangle or a diamond; and between 3 and 5 second heat insulating block are filled therein, so that both the strength and the thermal insulation of the permanent layer are ensured.

In a class of this embodiment, the first heat insulating blocks are heat insulating blocks having a compressive strength of between 5 and 20 megapascal, a bulk density of between 0.6 and 1.5 g/cm$^3$, a thermal conductivity at 800° C. of between 0.20 and 0.50 W/mk. The second heat insulating blocks are heat insulating blocks having a compressive strength of between 0.10 and 0.50 megapascal, a bulk density of between 0.2 and 0.5 g/cm$^3$, and a thermal conductivity at 800° C. of between 0.04 and 0.15 W/mk. A thickness of the inner permanent layer is between 5 and 50 mm. A thickness of the outer permanent layer is between 5 and 30 mm. Therefore, by the above optimization of the performance parameters, the optimal structure strength and the thermal insulation performance can be realized with the relatively small thickness.

Advantages of the third smelting ladle according to embodiments of the invention are as follows: the excellent thermal insulation performance of the second heat insulating block and the strong properties of corrosion resistance and high temperature resistance of the first heat insulating block are fully utilized. Because the first heat insulating block is utilized as the supporting skeletons, the thermal insulation performance of the permanent layer is ensured and at the same time the integral strength of the thermal insulation layer is greatly improved, both the thermal insulation performance and the strength requirement are ensured, and thus the collapse of the thermal insulation layer resulting from the too low strength of the thermal insulation material with low conductivity is prevented. As the inner permanent layer adopts the first heat insulating block, the working temperature of the outer permanent layer can be effectively decreased, and working temperature of the second heat insulating block is kept to be lower than the highest working temperature. The permanent layer of the smelting ladle masoned by the above method features use safety and the thermal insulation of the smelting ladle wall, prolonged service life of the permanent layer, further improved service cycle, and the reduced material consumption.

In accordance with still another embodiment of the invention, there is provided a fourth smelting ladle. The smelting ladle comprises: the housing, the permanent layer, the circulating working layer, and the consumable working layer. The permanent layer is masoned on an inner wall of the housing, the circulating working layer is casted on the inner wall of the permanent layer, and the consumable working layer is masoned on an inner wall of the circulating working layer. A castable of the circulating working layer comprises: between 55 and 70 parts by weight of a sintered microporous corundum aggregate, between 5 and 10 parts by weight of a magnesia-alumina spinel aggregate, between 10 and 25 parts of a fine powder, between 2 and 8 parts by weight of a micro powder, between 3 and 8 parts by weight of a binder, between 0.1 and 0.5 part by weight of a detonation suppressor, between 0.05 and 2 parts by weight of a water reducing agent, and between 0.01 and 0.1 part by weight of a foaming agent. The fine powder comprises a component A and a component B. The component A is one selected from a fused white corundum and a sintered tubular corundum, and the component B is one selected from a magnesia-alumina spinel and a magnesia. The micro powder is a mixture of a $SiO_2$ fine powder and an active $\alpha$-$Al_2O_3$ fine powder or a mixture of the $SiO_2$ fine powder and a sintered tubular corundum fine powder.

In a class of this embodiment, the sintered microporous corundum aggregate has a content of $Al_2O_3$ of ≥99.5 wt. %, a bulk density of between 3.0 and 3.4 g/cm$^3$, a closed porosity of ≥10%, an average pore diameter inside a particle of ≤1.0 μm, and a particle size of ≤25 mm.

The sintered microporous corundum aggregate possesses excellent use strength and volume stability at the high temperature. A large quantity of micropores is formed therein, which is able to effectively reduce the thermal conductivity of the castable and improve the thermal insulation of the castable. Compared with the common sintered corundum which has a bulk density of approximately between 3.60 and 3.65 g/cm$^3$, the materials have very low bulk density, so that the consumption of the refractory for each ton of steel is further reduced.

In a class of this embodiment, the sintered microporous corundum aggregate is divided into particles of five levels according to particle sizes thereof: 12 mm<a particle size of a first level ≤25 mm, 7 mm<the particle size of a second level ≤12 mm, 3 mm<the particle size of a third level ≤7 mm, 1 mm<the particle size of a fourth level ≤3 mm, and 0 mm<the particle size of a fifth level ≤1 mm. Weight percentages thereof are correspondingly as follows: 13-17 wt. %, 28-32 wt. %, 18-22 wt. %, 18-22 wt. %, and 13-15 wt. %.

In a class of this embodiment, the magnesia-alumina spinel aggregate comprises between 10 and 40 wt. % of MgO and between 60 and 90 wt. % of $Al_2O_3$. A particle size of the magnesia-alumina spinel aggregate is ≤3 mm. The magnesia is a fused magnesia comprising ≥97 wt. % of MgO or a sintered magnesia comprising ≥97 wt. % of MgO.

In a class of this embodiment, the component A and the component B in the fine powder have particle sizes of ≤0.088 mm, and a weight ratio of the component A to the component B is between 1:1 and 6:1.

In a class of this embodiment, the $SiO_2$ fine powder has a content of $SiO_2$ of ≥92 wt. % and a particle size of $D_{50}$≤5 μm. The $\alpha$-$Al_2O_3$ fine powder has a content of $\alpha$-$Al_2O_3$ of ≥99 wt. % and a particle size of $D_{50}$≤5 μm. The sintered tubular corundum fine powder has a content of $Al_2O_3$ of ≥99.5 wt. %, a particle size of $D_{50}$=1.7-3.4 μm, and a specific area of BET=1.0-4.1 m$^2$/g. The weight ratio of the $SiO_2$ fine powder to the active $\alpha$-$Al_2O_3$ fine powder is between 1:10 and 1:20. The weight ratio of the $SiO_2$ fine powder to the sintered tubular corundum fine powder is between 1:10 and 1:20.

In a class of this embodiment, the binder is selected from the group consisting of a calcium aluminate cement, a $\rho$-$Al_2O_3$ binder, a silica-alumina gel, and a combination thereof. The calcium aluminate cement comprises ≥69 wt. % of $Al_2O_3$ and ≤30 wt. % of CaO. The $\rho$-$Al_2O_3$ binder comprises ≥85 wt. % of $Al_2O_3$.

In a class of this embodiment, the detonation suppressor is a mixture of a tubular organic fiber and a water-soluble organic fiber. the tubular organic fiber has a melting point of ≤115° C., a length of ≤4 mm, a diameter of between 60 and 80 μm, and a density of ≤0.56 g/cm$^3$. the water-soluble organic fiber has a length of ≤4 mm, a diameter of between 20 and 40 μm. A weight ratio of the tubular organic fiber to the water-soluble organic fiber is between 1.5:1 and 2:1.

Both the tubular organic fiber and the water-soluble organic fiber are purchased from Shenyang Sidien Chemical Fiber Co. Ltd. The water-soluble organic fiber is dissolved in processes of stirring with water and vibrating compaction, leaving a certain amount of air holes and effectively blocking the expansion of the crevices, so that the thermal shock resistance of the castable is further improved. The tubular organic fiber functions in exhausting gas during baking after the moulding process of the castable and is melted when the baking temperature increases, so that a certain amount of gas holes are formed, and the exhausting function of the castable is further reinforced. As the tubular organic fibers and the water-soluble organic fiber are complementary in their functions, the cooperative use thereof ensures that both the explosive spalling resistance and the thermal shock resistance of the castable are significantly improved at different temperature ranges.

In a class of this embodiment, the foaming agent is selected from the group consisting of sodium dodecyl benzene sulfonate, sodium dodecyl sulfate, an aluminum powder, and a mixture thereof. A particle size of the aluminum powder is between 0.15 and 0.3 mm.

A method for preparing the castable of the circulating working layer comprises the following steps:

1) weighing the sintered microporous corundum aggregate, the magnesia-alumina spinel aggregate, the fine powder, the micro powder, the binder, the detonation suppressor, the water reducing agent, and the foaming agent;

2) uniformly premixing the fine powder, the micropowder, the binder, the detonation suppressor, the water reducing agent, and the forming agent in a premixer to obtain a premix; and 3) adding the premix, the sintered microporous corundum aggregate, and magnesia-alumina spinel aggregate to a forced mixer for stirring until materials are uniformly stirred, and discharging and packing a resulting mixture to yield the castable.

When casting the circulating working layer, an required amount of the castable is collected and added with water having a weight accounting for between 4.5 and 6.0 wt. % of the castable for mixing for between 3 and 5 min, and a resulting mixture is then moulded by casting.

Advantages of the fourth smelting ladle according to embodiments of the invention are summarized as follows:

First of all, the safety factor in use and the service life of the smelting ladle are improved.

The castable of the circulating working layer mainly employs the corundum and the spinel with high fusion point, so that the castable possesses high strength even at high temperature, and excellent performance for resisting the souring of the molten steel and the erosion of the slag. When the consumable working layer masoned by the bricks is consumed to be between 0 and 20 mm, the circulating working layer can still maintain a long time of continuous use. Thus, on the one hand, the shortening of the service life of the whole working layer resulting from the safety problem is avoided, and the absolute safety factor in the use of the smelting lade is at least increased by between 3 and 5 times. On the other hand, the effective use ratio of the masoned bricks of the consumable working layer is greatly improved, and therefore the waste of the refractory resource is effectively decreased. Furthermore, with the prolonged service life of the circulating working layer, the service cycle of the refractory of the permanent layer is correspondingly prolonged. It is indicated from the effect of the practical use in the steel plant, the service life of the smelting ladle can be prolonged by 20%.

Second, the leakage of the molten steel from brick joints of the permanent layer is effectively blocked.

Because the castable of the circulating working layer contains the sintered microporous corundum and the spinel, both the refractorinesses of which are higher than 2000° C., the circulating working layer possesses excellent integrity even it is used at the high temperature for a long time. Thus, when the molten steel passes through the brick joints of the consumable working layer, the circulating working layer is able to block the penetration of the molten steel, thereby further reducing the hidden danger of perforation of the molten steel.

Third, the steel ladle has low thermal conductivity, good thermal insulation, and excellent thermal shock resistance.

The circulating working layer employs the sintered microporous corundum aggregate which possesses a large amount of closed micropores therein, and the use of the foaming agent further increases the microporosity of the substrate. Since the micropores are able to effectively prevent the expansion of the crevices, the thermal shock resistance of the circulating working layer is significantly improved, and the formation of the crevices is avoided in the long term operation of the smelting ladle. In the meanwhile, the thermal conductivity of the castable can be effectively lowered, thereby further improving the thermal insulation performance. In practice, the coefficient of the thermal conductivity of the circulating working layer prepared is only approximately 70% of that of the common corumdum castable.

Figure 1:
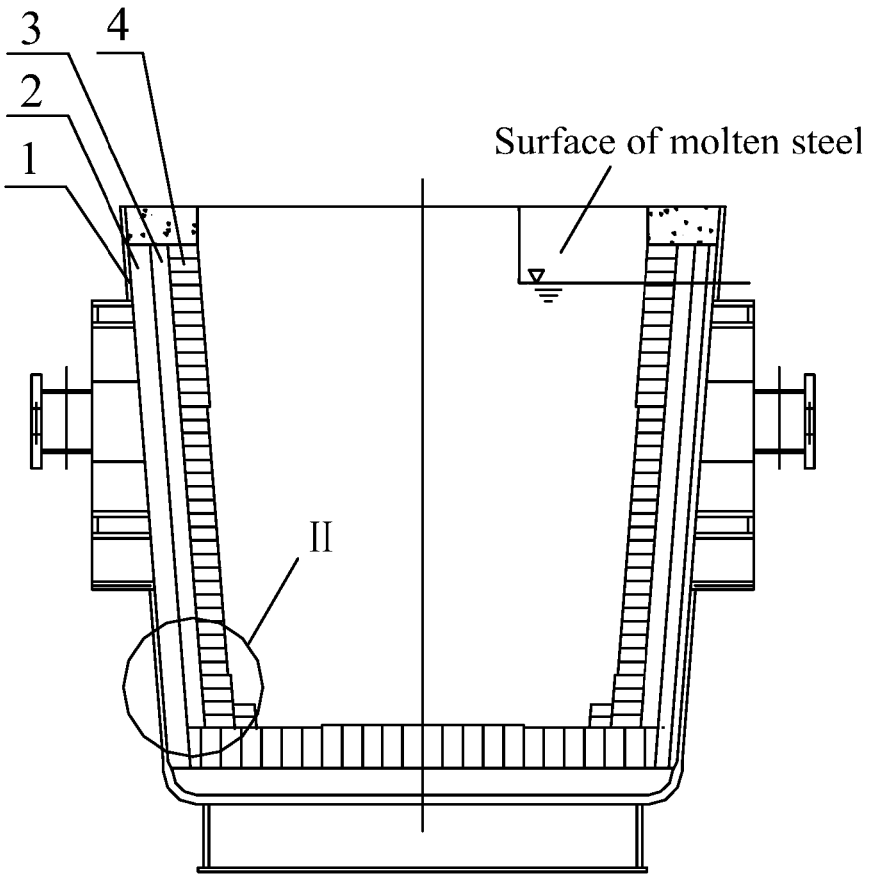
FIG. 1 is a structure diagram of a first smelting ladle in accordance with one embodiment of the invention.

In the drawings, the following reference numbers are used: 1. Housing; 2. Permanent layer (21. Inner permanent layer; 22. Outer permanent layer; 22*a*. First heat insulating block; 22*b*. Second heat insulating block); 3. Circulating working layer; 4. Consumable working layer.

DETAILED DESCRIPTION OF THE EMBODIMENTS

For further illustrating the invention, experiments detailing a smelting ladle and a method for improving use efficiency thereof are described hereinbelow combined with the drawings.

EXAMPLE 1

Figure 2:
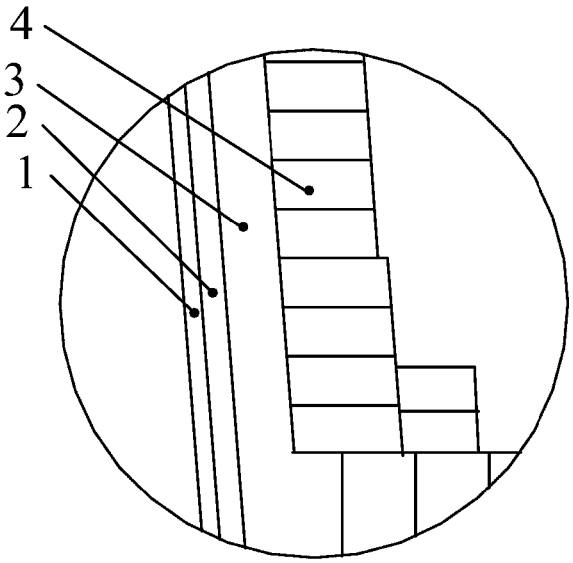
FIG. 2 is an enlarged view of Part II of FIG. 1.

A first smelting ladle is illustrated in FIGS. 1-2. The smelting ladle comprises a housing 1. A permanent layer 2 is masoned on an inner wall of the housing 1. A circulating working layer 3 is casted on an inner wall of the permanent layer 2, and the consumable working layer 4 is masoned on an inner wall of the circulating working layer 3. Specifically, the permanent layer 2 is masoned by a refractory having a bulk density of 0.5±0.2 g/cm$^3$, a compressive strength at a normal temperature of ≥2.0 megapascal, and a refractory temperature of ≥1100° C. A thickness of the permanent layer 2 is 65 mm. The circulating working layer 3 is casted by a corundum refractory castable having a bulk density of 2.7±0.2 g/cm$^3$ and a refractory temperature of ≥1600° C. A thickness of the circulating working layer 3 is 100 mm. The consumable working layer 4 is masoned by refractory bricks having a bulk density of 3.0±0.2 g/cm$^3$ and a refractory temperature of ≥1600° C. The thickness of the consumable working layer 4 is 150 mm.

The construction process of the smelting ladle is as follows: the permanent layer 2 is firstly masoned on the inner wall of the housing 1, and then the circulating working layer 3 is casted on the inner wall of the permanent layer 2. After the moulding, maintenance, and drying processes, the consumable working layer 4 is masoned on the circulating working layer 3.

In use of the smelting ladle, the consumable working layer 4 directly contacts the molten steel. The consumable working layer 4 is gradually attenuated under the scouring and erosion of the molten steel at the high temperature, and when the consumable working layer 4 is consumed to the thickness of between 0 and 20 mm, a smelting stage of the smelting ladle is completed. Then the smelting ladle is stopped from using and the maintenance thereof is conducted, and a new consumable working layer 4 is masoned again to realize the full utilization of the consumable working layer. During such period, the circulating working layer 3 can be firstly cleaned and repaired when being partially eroded, and the new consumable working layer 4 is then masoned on the outer layer of the circulating working layer 3. The above processes are repeated until the circulating working layer 3 reaches the service life thereof, and the new circulating working layer 3 is re-casted. In this embodiment, the designed service life of the circulating working layer 3 is at least ten smelting stages of the smelting ladle. And in some special circumstance, the circulating working layer 3 can be directly used as the consumable working layer 4 when the consumable working layer 4 is completely consumed.

EXAMPLE 2

The integral structure of the smelting ladle of Example 2 is the same as that of Example 1 except that the permanent layer 2 is masoned by a refractory having a bulk density of 1.5±0.2 g/cm$^3$, a compressive strength at a normal temperature of ≥8.0 megapascal, and a refractory temperature of ≥1100° C. A thickness of the permanent layer 2 is 60 mm. The circulating working layer 3 is casted by a corundum refractory castable having a bulk density of 2.9±0.2 g/cm$^3$ and a refractory temperature of ≥1600° C. A thickness of the circulating working layer 3 is 120 mm. The consumable working layer 4 is masoned by refractory bricks having a bulk density of 3.1±0.2 g/cm$^3$ and a refractory temperature of ≥1600° C. The thickness of the consumable working layer 4 is 140 mm.

EXAMPLE 3

The integral structure of the smelting ladle of Example 3 is the same as that of Example 1 except that the permanent layer 2 is masoned by a refractory having a bulk density of 1.8±0.2 g/cm$^3$, a compressive strength at a normal temperature of ≥10.0 megapascal, and a refractory temperature of ≥1100° C. A thickness of the permanent layer 2 is 100 mm. The circulating working layer 3 is casted by a corundum refractory castable having a bulk density of 3.1±0.2 g/cm$^3$ and a refractory temperature of ≥1600° C. A thickness of the circulating working layer 3 is 20 mm. The consumable working layer 4 is masoned by refractory bricks having a bulk density of 3.1±0.2 g/cm$^3$ and a refractory temperature of ≥1600° C.; and the thickness of the consumable working layer 4 is 200 mm.

EXAMPLE 4

Figure 3:
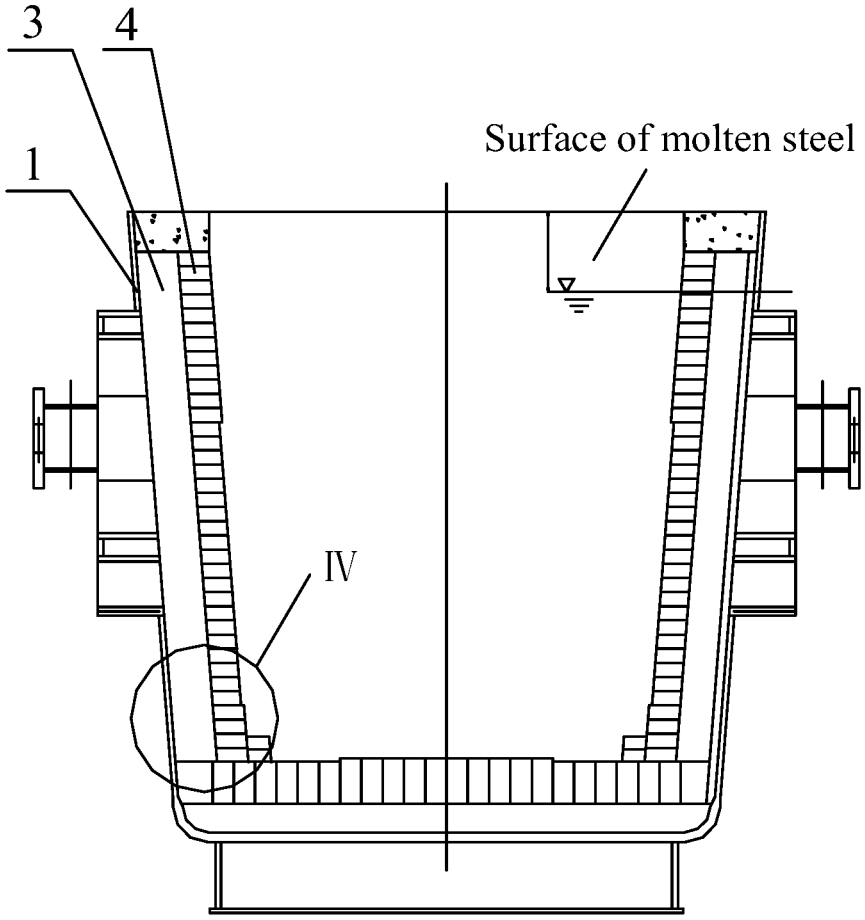
FIG. 3 is a structure diagram of a second smelting ladle in accordance with one embodiment of the invention.
Figure 4:
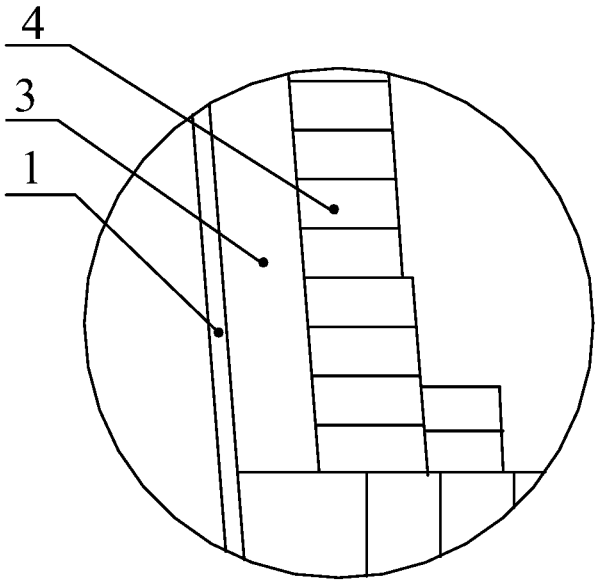
FIG. 4 is an enlarged view of Part IV of FIG. 3.

A second smelting ladle is illustrated in FIGS. 3-4. The smelting ladle comprises a housing 1. A circulating working layer 3 is casted on an inner wall of the housing 1, and a consumable working layer 4 is masoned on an inner wall of the circulating working layer 3. The smelting ladle of this example is not configured with a permanent layer 2. Specifically, the circulating working layer 3 is moulded by casting a corundum refractory castable having a bulk density of 2.9±0.2 g/cm$^3$ and a refractory temperature of ≥1600° C. A thickness of the circulating working layer 3 is 250 mm. The consumable working layer 4 is masoned by refractory bricks having a bulk density of 3.2±0.2 g/cm$^3$ and a refractory temperature of ≥1600° C. The thickness of the consumable working layer 4 is 80 mm.

Construction process of the smelting ladle is as follows: the circulating working layer 3 is casted on the inner wall of the housing 1, moulded, maintained, and dried; then the consumable working layer 4 is masoned on the inner wall of the circulating working layer 3.

The method of using the smelting ladle of Example 4 is substantially the same as those in Examples 1-3, therefore will not be repeated herein.

The above Examples 1-3 have been tested in the smelting ladle reconstruction on site in a large scale steel plant, and the usages thereof indicate that before the reconstruction of the smelting ladle, an average service life of the permanent layer is approximately 500 heats, an average service life of the working layer is approximately 100 heats, the consumption of the refractory for each ton of the molten steel is approximately 4.5 kilogram, and a total of 13 ton of residual bricks of the working layer are discarded; and after employing the smelting ladle with the long service life and the low material consumption of Examples 1-3, the average service life of the permanent layer 2 exceeds 1000 heats, the average service life of the circulating working layer 3 exceeds 1000 heats, the average service life of the consumable working layer 4 exceeds 135 heats, the consumption of the refractory for each ton of the molten steel is reduced to 2.3 kilogram, and an obsolete quantity of the residual bricks is reduced to 3 tons. Thus, the smelting ladle of the invention is able to greatly reduce the consumption of the refractory for each ton of the molten steel and the obsolete quantity of the consumable working layer on the premise of ensuring the thermal insulation performance of the smelting ladle, therefore effective decrease the operation cost.

EXAMPLE 5

Figure 5:
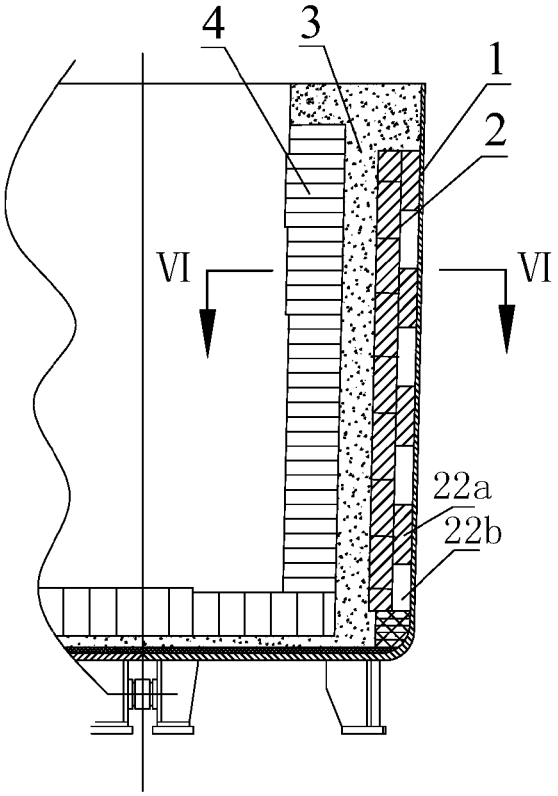
FIG. 5 is a first structure diagram of a third smelting ladle in accordance with one embodiment of the invention.
Figure 6:
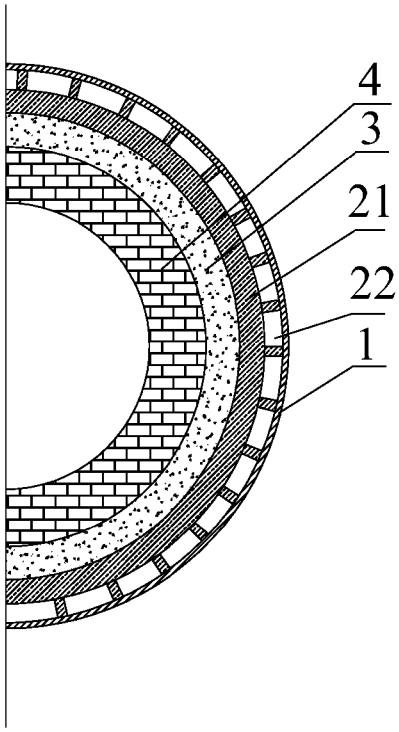
FIG. 6 is a cross sectional view taken from line VI-VI of FIG. 5.
Figure 7:
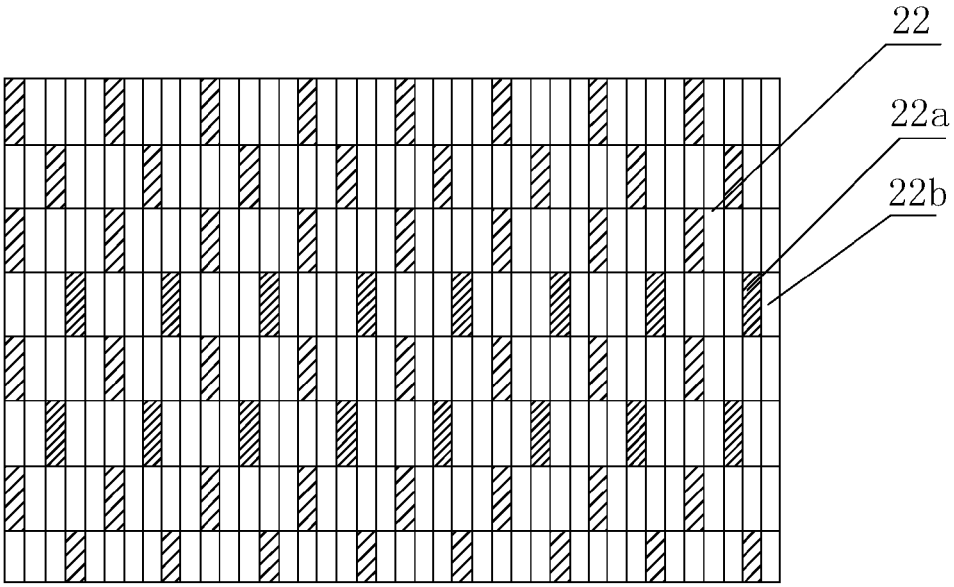
FIG. 7 is an expanded view of an outer permanent layer of FIG. 5.

A third smelting ladle is illustrated in FIGS. 5-7. The smelting ladle comprises a housing 1. A permanent layer 2 is masoned on an inner wall of the housing 1, a circulating working layer 3 is casted on the inner wall of the permanent layer 2, and a consumable working layer 4 is masoned on an inner wall of the circulating working layer 3. The permanent layer 2 is formed by an inner permanent layer 21 contacting with the circulating working layer 3 and an outer permanent layer 22 contacting with the housing 1. The inner permanent layer 21 is masoned by first heat insulating blocks 22*a*. The outer permanent layer 22 is masoned by alternate arrangement of the first heat insulating blocks 22*a* and second heat insulating blocks 22*b*. Specifically, the first heat insulating blocks 22*a* are alternately disposed in a circumferential direction to form eight circles from top downwards along the inner wall of the housing 1. Four second heat insulating blocks 22*b* are disposed between adjacent first heat insulating blocks 22*a* of a same circle. First heat insulating blocks 22*a* of adjacent two circles are staggered. Similar to a bridge-like structure, the first heat insulating block 22*a* functions as a bridge pier, and the second heat insulating block 22*b* functions as a bridge deck.

In this example, the inner permanent layer 21 has a thickness of between 5 and 50 mm, and the outer permanent layer 22 has a thickness of between 5 and 30 mm. The first heat insulating block 22*a* employs heat insulating blocks having a compressive strength of between 5 and 20 megapascal, a bulk density of between 0.6 and 1.5 g/cm$^3$, a thermal conductivity at 800° C. of between 0.20 and 0.50 W/mk. The second heat insulating block 22*b* employs heat insulating blocks having a compressive strength of between 0.10 and 0.50 megapascal, a bulk density of between 0.2 and 0.5 g/cm$^3$, and a thermal conductivity at 800° C. of between 0.04 and 0.15 W/mk.

EXAMPLE 6

Figure 8:
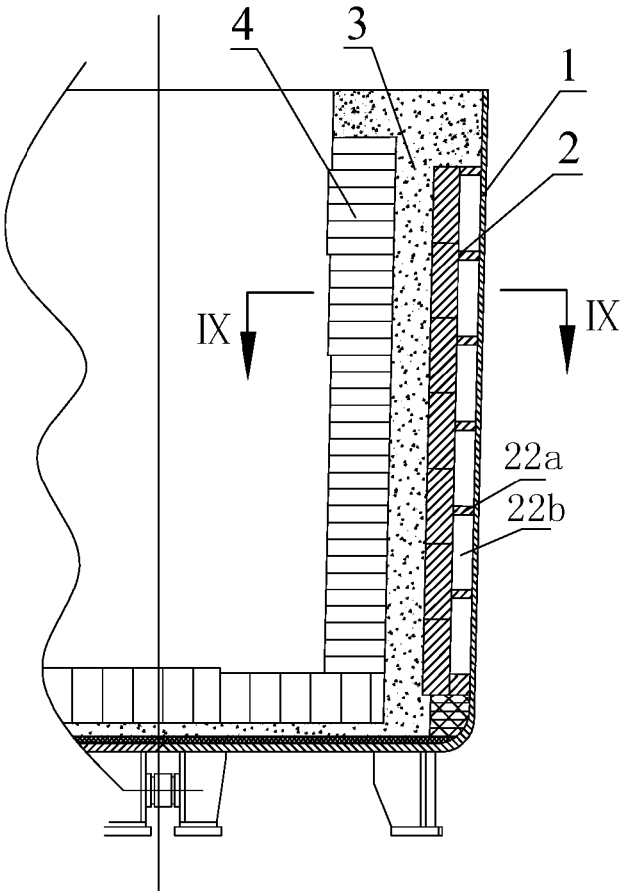
FIG. 8 is a second structure diagram of a third smelting ladle in accordance with one embodiment of the invention.
Figure 9:
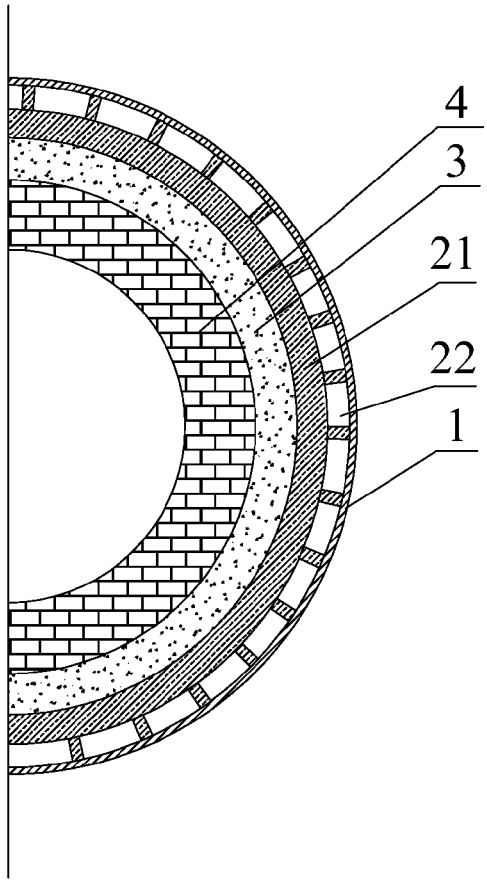
FIG. 9 is a cross sectional view taken from line IX-IX of FIG. 8.
Figure 10:
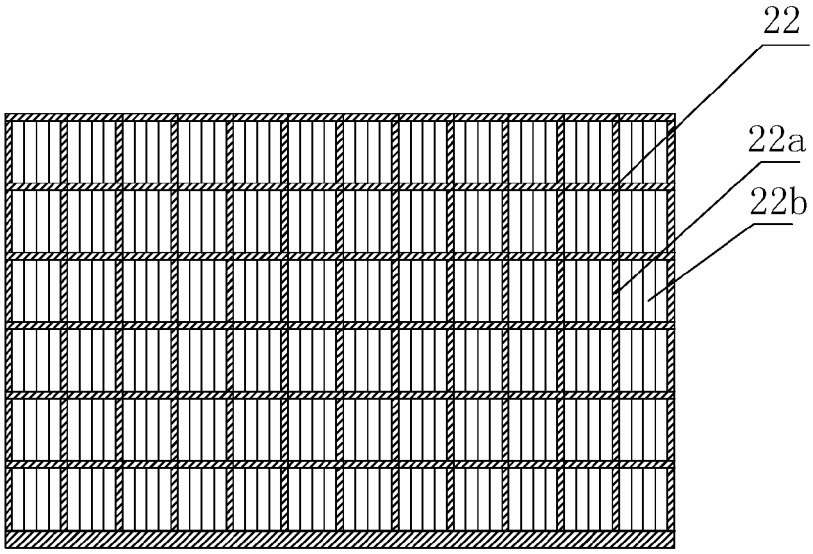
FIG. 10 is an expanded view of an outer permanent layer of FIG. 8.

Another third smelting ladle is illustrated in FIGS. 8-10. An integral structure of the smelting ladle in this example is basically the same as that of Example 5 except that the first heat insulating blocks 22*a* are arranged to form a network structure from the top downwards along the inner wall of the housing 1, and four second heat insulating block 22*b* are filled in rectangular cavities of the network structure. The network structure can also adopt diamond cavities. The first heat insulating blocks and the second heat insulating blocks form structures similar to a Chinese character JIN, the first heat insulating blocks form supporting skeletons, and the multiple second heat insulating blocks form thermal insulation surfaces.

The smelting ladle of Examples 5-6 utilizes a combined construction of the first heat insulating blocks 22*a* and the second heat insulating blocks 22*b* to fully utilize the advantages of both the heat insulating blocks, to ensure the strength and the thermal insulation of the permanent layer, thereby realizing the optimal configuration of the materials. Thus, the smelting ladle possesses not only excellent erosion resistance and high safety performance, but also the excellent thermal insulation performance. The use cycle is further prolonged, the material consumption is reduced, and the service life of the smelting ladle is prolonged.

EXAMPLE 7

A fourth smelting ladle can also refer to FIG. 1-2. The smelting ladle comprises a housing 1. A permanent layer 2 is masoned on an inner wall of the housing 1, a circulating working layer 3 is casted on the inner wall of the permanent layer 2, and a consumable working layer 4 is masoned on an inner wall of the circulating working layer 3. The castable of the circulating working layer 3 is optimized, and all the raw materials for preparing the castable are purchased from the market, and are specifically as follows:

The sintered microporous corundum aggregate has a content of $Al_2O_3$ of ≥99.5 wt. %, a bulk density of between 3.0 and 3.4 g/cm$^3$, a closed porosity of ≥10%, an average pore diameter inside a particle of ≤1.0 μm.

The magnesia-alumina spinel aggregate comprises between 10 and 40 wt. % of MgO and between 60 and 90 wt. % of $Al_2O_3$.

A fused magnesia comprises ≥97 wt. % of MgO. A sintered magnesia comprises ≥97 wt. % of MgO.

The $SiO_2$ fine powder has a content of $SiO_2$ of ≥92 wt. % and a particle size of $D_{50}$≤5 μm. The α-$Al_2O_3$ fine powder has a content of α-$Al_2O_3$ of ≥99 wt. % and a particle size of $D_{50}$≤5 μm.

The sintered tubular corundum fine powder has a content of $Al_2O_3$ of ≥99.5 wt. %, a particle size of $D_{50}$=1.7-3.4 μm, and a specific area of BET=1.0-4.1 m$^2$/g. In specific embodiments, three products (product numbers: CL370, CT800, and CTC50) manufactured by Almatis (Qingdao) Co., Ltd., as shown in Table 1:

TABLE 1

Technical parameters of three materials

| Product number | Content of $Al_2O_3$ (wt. %) | Particle size of $D_{50}$ | BET |
|---|---|---|---|
| CL370 | ≥99.5% | 2.6 μm | 3.0 m$^2$/g |
| CT800 | ≥99.5% | 3.4 μm | 1.0 m$^2$/g |
| CTC50 | ≥99.5% | 1.7 μm | 4.1 m$^2$/g |

The water reducing agent is a polycarboxylate based water reducing agent, which meets the standard of the Building Industry standard of the People's Republic of China (JG/T223-2007). In specific embodiment, the water reducing agent adopts products (product numbers of ADS1 and ADW1) purchased from the Almatis (Qingdao) Co., Ltd) or products (product numbers of FS60 and FS65) purchased from the BASF company from Germany.

The calcium aluminate cement has a content of $Al_2O_3$ of ≥69 wt. %. The ρ-$Al_2O_3$ binder has a content of $Al_2O_3$ of ≥85 wt. %.

Both the tubular organic fiber and the water-soluble organic fiber are purchased from Shenyang Sidien Chemical Fiber Co. Ltd. The tubular organic fiber has the melting point of ≤115° C., a length of ≤4 mm, a diameter of between 60 and 80 μm, and a density of ≤0.56 g/cm$^3$. The water-soluble organic fiber has a length of ≤4 mm and a diameter of between 20 and 40 μm.

Specific formulas of the castable of the circulating working layer 3 are as follows:

Formula for a First Castable

The castable of the circulating working layer 3 comprises: 55 parts by weight of a sintered microporous corundum aggregate, 10 parts by weight of a magnesia-alumina spinel aggregate, 20 parts by weight of a fine powder, 5 parts by weight of a micropowder, 5 parts by weight of a binder, 0.3 part by weight of a detonation suppressor, 1 part by weight of a water reducing agent, and 0.05 part by weight of a foaming agent.

The sintered microporous corundum aggregate is divided into particles of five levels according to particle sizes thereof: 12 mm<a particle size of a first level ≤25 mm, 7 mm<the particle size of a second level ≤12 mm, 3 mm<the particle size of a third level ≤7 mm, 1 mm<the particle size of a fourth level ≤3 mm, and 0 mm<the particle size of a fifth level ≤1 mm. Weight percentages thereof are correspondingly as follows: 13 wt. %, 32 wt. %, 18 wt. %, 22 wt. %, and 15 wt. %.

The fine powder is a mixture of a fused white corundum and a magnesia-alumina spinel, and a weight ratio of the fused white corundum to the magnesia-alumina spinel is 6:1.

The micropowder is a mixture of a $SiO_2$ fine powder and an active α-$Al_2O_3$ fine powder, and a weight ratio of the $SiO_2$ fine powder to the active α-$Al_2O_3$ fine powder is 1:30.

The binder is the calcium aluminate cement, and a product number of the binder is ADS1/ADW1. The foaming agent is sodium dodecyl sulfate.

The detonation suppressor is a mixture of the tubular organic fiber and the water-soluble organic fiber. A weight ratio of the tubular organic fiber to the water-soluble organic fiber is 1.5:1.

Formula for a Second Castable

The castable of the circulating working layer 3 comprises: 60 parts by weight of a sintered microporous corundum aggregate, 5 parts by weight of a magnesia-alumina spinel aggregate, 20 parts by weight of a fine powder, 8 parts by weight of a micropowder, 7 parts by weight of a binder, 0.1 part by weight of a detonation suppressor, 0.1 part by weight of a water reducing agent, and 0.1 part by weight of a foaming agent.

The sintered microporous corundum aggregate is divided into particles of five levels according to particle sizes thereof: 12 mm<a particle size of a first level ≤25 mm, 7 mm<the particle size of a second level ≤12 mm, 3 mm<the particle size of a third level ≤7 mm, 1 mm<the particle size of a fourth level ≤3 mm, and 0 mm<the particle size of a fifth level ≤1 mm. Weight percentages thereof are correspondingly as follows: 17 wt. %, 28 wt. %, 22 wt. %, 18 wt. %, and 15 wt. %.

The fine powder is a mixture of a sintered tubular corundum and a fused magnesia, and a weight ratio of the sintered tubular corundum to the fused magnesia is 3:1.

The micropowder is a $SiO_2$ micropowder and a sintered tubular corundum fine powder (product number CL370), and a weight ratio of the $SiO_2$ micropowder to the sintered tubular corundum fine powder is 1:25.

The binder is a mixture of a $\rho$-$Al_2O_3$ binder and an alumina gel, and a weight ratio of the $\rho$-$Al_2O_3$ binder to the alumina gel is 3:1.

A product number of the reducing agent is FS60, and a foaming agent is sodium dodecyl benzene sulfonate (purchased from BASF company from Germany).

The detonation suppressor is a mixture of the tubular organic fiber and the water-soluble organic fiber. A weight ratio of the tubular organic fiber to the water-soluble organic fiber is 2:1.

Formula for a Third Castable

The castable of the circulating working layer 3 comprises: 65 parts by weight of a sintered microporous corundum aggregate, 8 parts by weight of a magnesia-alumina spinel aggregate, 25 parts by weight of a fine powder, 6 parts by weight of a micropowder, 4 parts by weight of a binder, 0.2 part by weight of a detonation suppressor, 2 parts by weight of a water reducing agent, and 0.1 part by weight of a foaming agent.

The sintered microporous corundum aggregate is divided into particles of five levels according to particle sizes thereof: 12 mm<a particle size of a first level ≤25 mm, 7 mm<the particle size of a second level ≤12 mm, 3 mm<the particle size of a third level ≤7 mm, 1 mm<the particle size of a fourth level ≤3 mm, and 0 mm<the particle size of a fifth level ≤1 mm. Weight percentages thereof are correspondingly as follows: 15 wt. %, 30 wt. %, 20 wt. %, 20 wt. %, and 15 wt. %.

The fine powder is a mixture of a sintered tubular corundum and a sintered magnesia, and a weight ratio of the sintered tubular corundum to the sintered magnesia is 1:1.

The micropowder is a mixture of a $SiO_2$ micropowder and a sintered tubular corundum fine powder, and a weight ratio of the $SiO_2$ micropowder and the sintered tubular corundum fine powder is 1:20. And the sintered tubular corundum fine powder is prepared by mixing a product number of CL370 and a product number of CTC 50 according to a weight ratio of 1:1.

The binder is an alumina gel; a product number of the reducing agent is FS65; and the forming agent is an aluminum powder.

The detonation suppressor is a mixture of the tubular organic fiber and the water-soluble organic fiber; and a weight ratio of the tubular organic fiber to the water-soluble organic fiber is 1.8:1.

Formula for a Fourth Castable

The castable of the circulating working layer 3 comprises: 70 parts by weight of a sintered microporous corundum aggregate, 5 parts by weight of a magnesia-alumina spinel aggregate, 10 parts by weight of a fine powder, 8 parts by weight of a micropowder, 7 parts by weight of a binder, 0.5 part by weight of a detonation suppressor, 0.05 part by weight of a water reducing agent, and 0.1 part by weight of a foaming agent.

The sintered microporous corundum aggregate is divided into particles of five levels according to particle sizes thereof: 12 mm<a particle size of a first level ≤25 mm, 7 mm<the particle size of a second level ≤12 mm, 3 mm<the particle size of a third level ≤7 mm, 1 mm<the particle size of a fourth level ≤3 mm, and 0 mm<the particle size of a fifth level ≤1 mm; and weight percentages thereof are correspondingly as follows: 16 wt. %, 29 wt. %, 21 wt. %, 21 wt. %, and 13 wt. %.

The fine powder is a mixture of a sintered tubular corundum and a fused magnesia, and a weight ratio of the sintered tubular corundum to the fused magnesia is 4:1.

The micropowder is a mixture of a $SiO_2$ micropowder and an $\alpha$-$Al_2O_3$ micropowder, and a weight ratio of the $SiO_2$ micropowder to the $\alpha$-$Al_2O_3$ micropowder is 1:22.

The binder is a mixture of a calcium aluminate cement and an alumina gel, and a weight ratio of the calcium aluminate cement to the alumina gel is 2:3. A product number of the reducing agent is ADS1/ADW1. The foaming agent is a mixture of sodium dodecyl benzene sulfonate and an aluminum powder, and a weight ratio of the sodium dodecyl benzene sulfonate to the aluminum powder is 1:1.

The detonation suppressor is a mixture of the tubular organic fiber and the water-soluble organic fiber; and a weight ratio of the tubular organic fiber to the water-soluble organic fiber is 2:1.

Formula for a Fifth Castable

The castable of the circulating working layer 3 comprises: 58 parts by weight of a sintered microporous corundum aggregate, 10 parts by weight of a magnesia-alumina spinel aggregate, 20 parts by weight of a fine powder, 6 parts by weight of a micropowder, 6 parts by weight of a binder, 0.5 part by weight of a detonation suppressor, 0.05 part by weight of a water reducing agent, and 0.07 part by weight of a foaming agent.

The sintered microporous corundum aggregate is divided into particles of five levels according to particle sizes thereof: 12 mm<a particle size of a first level ≤25 mm, 7 mm<the particle size of a second level ≤12 mm, 3 mm<the particle size of a third level ≤7 mm, 1 mm<the particle size of a fourth level ≤3 mm, and 0 mm<the particle size of a fifth level ≤1 mm; and weight percentages thereof are correspondingly as follows: 17 wt. %, 28 wt. %, 18 wt. %, 22 wt. %, and 15 wt. %.

The fine powder is a mixture of a fused white corundum and a sintered magnesia, and a weight ratio of the fused white corundum to the sintered magnesia is 6:1.

The micropowder is a mixture of a $SiO_2$ micropowder and an $\alpha$-$Al_2O_3$ fine powder, and a weight ratio of the $SiO_2$ micropowder to the $\alpha$-$Al_2O_3$ fine powder is 1:30.

The binder is an alumina gel; a product number of the reducing agent is FS60; and the forming agent is an aluminum powder.

The detonation suppressor is a mixture of the tubular organic fiber and the water-soluble organic fiber; and a weight ratio of the tubular organic fiber and the water-soluble organic fiber is 1.7:1.

Formula for a Sixth Castable

The castable of the circulating working layer 3 comprises: 66 parts by weight of a sintered microporous corundum aggregate, 5 parts by weight of a magnesia-alumina spinel aggregate, 15 parts by weight of a fine powder, 8 parts by weight of a micropowder, 6 parts by weight of a binder, 0.1 part by weight of a detonation suppressor, 0.1 part by weight of a water reducing agent, and 0.1 part by weight of a foaming agent.

The sintered microporous corundum aggregate is divided into particles of five levels according to particle sizes thereof: 12 mm<a particle size of a first level ≤25 mm, 7 mm<the particle size of a second level ≤12 mm, 3 mm<the particle size of a third level ≤7 mm, 1 mm<the particle size of a fourth level ≤3 mm, and 0 mm<the particle size of a fifth level ≤1 mm; and weight percentages thereof are correspondingly as follows: 13 wt. %, 32 wt. %, 22 wt. %, 18 wt. %, and 15 wt. %.

The fine powder is a mixture of a fused white corundum and a sintered tubular corundum (product number of CTC50 or CT800), and a weight ratio of the fused white corundum to the sintered tubular corundum is 1:1.

The micropowder is a mixture of a $SiO_2$ micropowder and an $\alpha$-$Al_2O_3$ fine powder, and a weight ratio of the $SiO_2$ micropowder to the $\alpha$-$Al_2O_3$ fine powder is 1:20.

The binder is a $\rho$-$Al_2O_3$ binder. A product number of the reducing agent is ADS1/ADW1. The forming agent is sodium dodecyl sulfate.

The detonation suppressor is a mixture of the tubular organic fiber and the water-soluble organic fiber; and a weight ratio of the tubular organic fiber to the water-soluble organic fiber is 2:1.

A method for preparing the above six castables comprises:

1) weighing the sintered microporous corundum aggregate, the magnesia-alumina spinel aggregate, the fine powder, the micro powder, the binder, the detonation suppressor, the water reducing agent, and the foaming agent;

2) uniformly premixing the fine powder, the micropowder, the binder, the detonation suppressor, the water reducing agent, and the forming agent in a premixer to obtain a premix;

3) adding the premix, the sintered microporous corundum aggregate, and magnesia-alumina spinel aggregate to a forced mixer for stirring until materials are uniformly stirred, and discharging and packing a resulting mixture to yield the castable.

When casting the circulating working layer, an required amount of the castable is collected and added with water having a weight accounting for between 4.5 and 6.0 wt. % of the castable for mixing for between 3 and 5 min, and a resulting mixture is then moulded by casting.

Performances of the circulating working layers manufactured by the above six castables are listed in Table 2.

TABLE 2

Performances of the circulating working layers manufactured by six castables

| Parameters | | Circulating working layer Circulating working layers manufactured by six castable 1 | 2 | 3 | 4 | 5 | 6 |
|---|---|---|---|---|---|---|---|
| Sintered under 110° C. × 24 hr | Flexural strength (megapascal) | ≥15 | ≥15 | ≥15 | ≥15 | ≥15 | ≥15 |
| | Compressive strength (megapascal) | ≥110 | ≥110 | ≥110 | ≥110 | ≥110 | ≥110 |
| | Bulk density (g/cm$^3$) | 2.92 | 2.90 | 2.91 | 2.90 | 2.92 | 2.93 |
| Sintered under 1600° C. × 3 hr | Flexural strength (megapascal) | ≥40 | ≥40 | ≥40 | ≥40 | ≥40 | ≥40 |
| | Compressive strength (megapascal) | ≥180 | ≥180 | ≥180 | ≥180 | ≥180 | ≥180 |
| | Linear change rate (%) | +0.52 | +0.58 | +0.58 | +0.53 | +0.50 | +0.59 |
| Flexural strength (megapascal) (sintered under 1400° C. × 0.5 hr) | | 3.53 | 3.81 | 3.66 | 3.72 | 3.65 | 3.76 |
| Thermal shock resistance (times) | | 18 | 20 | 18 | 19 | 20 | 20 |

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for improving use efficiency of a smelting ladle, the smelting ladle comprising a housing, a working layer, and a permanent layer, and the method comprising:

1) rebuilding the working layer to have an outer layer and an inner layer, wherein the inner layer is formed by masoning and directly contacts with molten steel and steel slag, and the outer layer is formed by casting, contacts with the permanent layer or directly contacts with the housing, and comprises between 55 and 70 parts by weight of a sintered microporous corundum aggregate, between 5 and 10 parts by weight of a magnesia-alumina spinel aggregate, between 10 and 25 parts of a fine powder, between 2 and 8 parts by weight of a micro powder, between 3 and 8 parts by weight of a binder, between 0.1 and 0.5 part by weight of a detonation suppressor, between 0.05 and 2 parts by weight of a water reducing agent, and between 0.01 and 0.1 part by weight of a foaming agent;

2) allowing the smelting ladle to work, when a thickness of the inner layer is reduced to be between 0 and 20 mm, which means a smelting stage of the smelting ladle is completed, removing a residue of the inner layer and masoning a new inner layer for the smelting ladle; and 3) repeating 2) until the outer layer reaches a designed service life thereof, and casting a new outer layer for the smelting ladle.

2. The method of claim 1, wherein when the outer layer is partially eroded after one smelting stage of the smelting ladle, firstly, the outer layer is cleaned and repaired, and then the new inner layer is masoned; and the designed service life of the outer layer is at least 10 times as long as the smelting stage of the smelting ladle.

3. The method of claim 1, wherein the fine powder comprises a component A and a component B; the component A is one selected from a fused white corundum and a sintered tubular corundum, and the component B is one selected from a magnesia-alumina spinel and a magnesia.

4. The method of claim 1, wherein the micro powder is a mixture of a $SiO_2$ fine powder and an active $\alpha$-$Al_2O_3$ fine powder or a mixture of the $SiO_2$ fine powder and a sintered tubular corundum fine powder.

5. The method of claim 1, wherein the sintered microporous corundum aggregate has a content of $Al_2O_3$ of ≥99.5 wt. %, a bulk density of between 3.0 and 3.4 g/cm$^3$, a closed porosity of ≥10%, an average pore diameter inside a particle of ≤1.0 μm, and a particle size of ≤25 mm.

6. The method of claim 1, wherein the sintered microporous corundum aggregate is divided into particles of five levels according to particle sizes thereof: 12 mm<a particle size of a first level ≤25 mm, 7 mm<the particle size of a second level ≤12 mm, 3 mm<the particle size of a third level ≤7 mm, 1 mm<the particle size of a fourth level ≤3 mm, and 0 mm<the particle size of a fifth level ≤1 mm; and weight percentages thereof are correspondingly as follows: 13-17 wt. %, 28-32 wt. %, 18-22 wt. %, 18-22 wt. %, and 13-15 wt. %.

7. The method of claim 1, wherein the magnesia-alumina spinel aggregate comprises between 10 and 40 wt. % of MgO and between 60 and 90 wt. % of $Al_2O_3$; a particle size of the magnesia-alumina spinel aggregate is ≤3 mm; and the magnesia is a fused magnesia comprising ≥97 wt. % of MgO or a sintered magnesia comprising ≥97 wt. % of MgO.

8. The method of claim 1, wherein the binder is selected from the group consisting of a calcium aluminate cement, a ρ-$Al_2O_3$ binder, a silica-alumina gel, and a combination thereof;

the calcium aluminate cement comprises ≥69 wt. % of $Al_2O_3$ and ≤30 wt. % of CaO; and the ρ-$Al_2O_3$ binder comprises ≥85 wt. % of $Al_2O_3$.

9. The method of claim 1, wherein the detonation suppressor is a mixture of a tubular organic fiber and a water-soluble organic fiber;

the tubular organic fiber has a melting point of ≤115° C., a length of ≤4 mm, a diameter of between 60 and 80 μm, and a density of ≤0.56 g/cm$^3$;

the water-soluble organic fiber has a length of ≤4 mm, a diameter of between 20 and 40 μm; and a weight ratio of the tubular organic fiber to the water-soluble organic fiber is between 1.5:1 and 2:1.

10. The method of claim 1, wherein the water reducing agent is a polycarboxylate based water reducing agent.

11. The method of claim 1, wherein the foaming agent is selected from the group consisting of sodium dodecyl benzene sulfonate, sodium dodecyl sulfate, an aluminum powder, and a mixture thereof; and a particle size of the aluminum powder is between 0.15 and 0.3 mm.

12. The method of claim 3, wherein the component A and the component B have particle sizes of ≤0.088 mm, and a weight ratio of the component A to the component B is between 1:1 and 6:1.

13. The method of claim 4, wherein the $SiO_2$ fine powder has a content of $SiO_2$ of ≥92 wt. % and a particle size of $D_{50}$≤5 μm; the α-$Al_2O_3$ fine powder has a content of α-$Al_2O_3$ of ≥99 wt. % and a particle size of $D_{50}$≤5 μm; the sintered tubular corundum fine powder has a content of $Al_2O_3$ of ≥99.5 wt. %, a particle size of $D_{50}$=1.7-3.4 μm, and a specific area of BET=1.0-4.1 m$^2$/g; a weight ratio of the $SiO_2$ fine powder to the active α-$Al_2O_3$ fine powder is between 1:10 and 1:20; and the weight ratio of the $SiO_2$ fine powder to the sintered tubular corundum fine powder is between 1:10 and 1:20.

* * * * *